US005175934A

United States Patent [19]

Chao

[11] Patent Number: 5,175,934

[45] Date of Patent: Jan. 5, 1993

[54] UTILITY KNIFE

[76] Inventor: Chung-liang Chao, No. 7-5, Lane 339, Wu Chuan Rd., Taichung, Taiwan

[21] Appl. No.: 887,480

[22] Filed: May 21, 1992

[51] Int. Cl.[5] ..... B26B 1/00; B26B 11/00; B24B 3/48; B43K 5/00

[52] U.S. Cl. ..... 30/329; 7/158; 51/159; 81/9.22

[58] Field of Search ..... 30/329, 330, 331, 332, 30/333, 337; 81/9.22; 51/155, 159; 401/172, 209; 7/158

[56] References Cited

U.S. PATENT DOCUMENTS

| | | | |
|---|---|---|---|
| 2,569,286 | 9/1951 | Bunker | 30/329 |
| 2,934,994 | 5/1960 | Casselman | 30/329 |
| 3,176,395 | 4/1965 | Warner et al. | 30/329 |
| 3,706,106 | 12/1972 | Leopoldi | 7/158 |
| 4,092,073 | 5/1978 | Anderson | 401/209 |
| 4,665,912 | 5/1987 | Burton | 81/9.22 |
| 4,862,772 | 9/1989 | Piperato | 81/9.22 |

*Primary Examiner*—Douglas D. Watts
*Assistant Examiner*—Paul M. Heyrana, Sr.
*Attorney, Agent, or Firm*—Woodcock Washburn Kurtz Mackiewicz & Norris

[57] ABSTRACT

A utility knife switchable between a non-rotatable mode for cutting a straight line and a rotatable mode for cutting a curved line includes a rod which engages to a blade at one end and the other end being rotatably positioned against a bearing device thereby providing the blade with a rotation axle for cutting a curve. A switching button device is installed above the limiting device for forcing the rod and the blade to work in a non-rotatable mode or a rotatable mode.

6 Claims, 3 Drawing Sheets

UTILITY KNIFE

BACKGROUND OF THE INVENTION

This invention relates to a utility knife, particularly to one which has a rotatable tip to be more flexibly used.

A utility knife used at the present time is suitable for cutting a straight line but does not easily cut a curved line; therefore, when a user wants to use a conventional utility knife to cut a curve, he must continually turn his hand to fit the required curve. However, the effect is usually not satisfactory, because tracing a curve is not easy to accomplish free-hand with a conventional utility knife.

It is required to have one kind of utility knife which does not require the user to keep turning his hand in order to cut a curve.

SUMMARY OF THE INVENTION

The present invention provides a utility knife which is switchable between a non-rotatable mode for cutting a straight line and a rotatable mode for cutting a curve.

It is an object of the present invention to provide a utility knife with a rotatable rod engaged with a blade for easy operation in cutting a curve.

It is another object of the present invention to provide a utility knife which is switchable to function in a non-rotatable mode for cutting a straight line and in a rotatable mode for cutting a curve thereby providing a more flexible use.

DETAILED DESCRIPTION OF THE PREFERRED EMBODIMENTS

Figure 1:
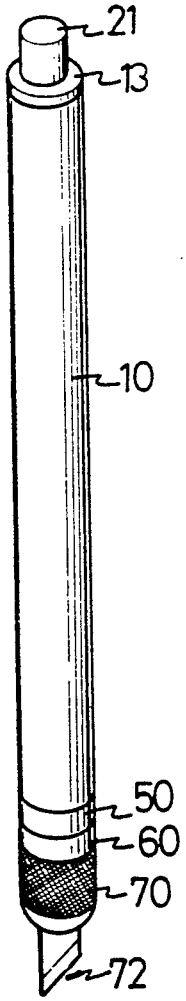
FIG. 1 is perspective view of a utility knife in accordance with the present invention.

Referring to FIG. 1, a utility knife of the present invention has a longitudinal outlook. A button 21 is slidably installed in an upper cap 11 which is further inserted into one end of a barrel 10. Inserted into the other end of the barrel 10 is a lower cap 50, which is engaged with a connector means 60, a head 70 connected to the connector means 60 having a blade 72 attached thereon. In FIG. 1, the utility knife is in a non-rotatable mode for cutting a straight line. If the button 21 is pressed (FIG. 4), the connector means 60 will disengage with the lower cap 50, and the utility knife will switch to a rotatable mode for cutting a curved line. The details of the rotatable mode will be described later.

Figure 2:
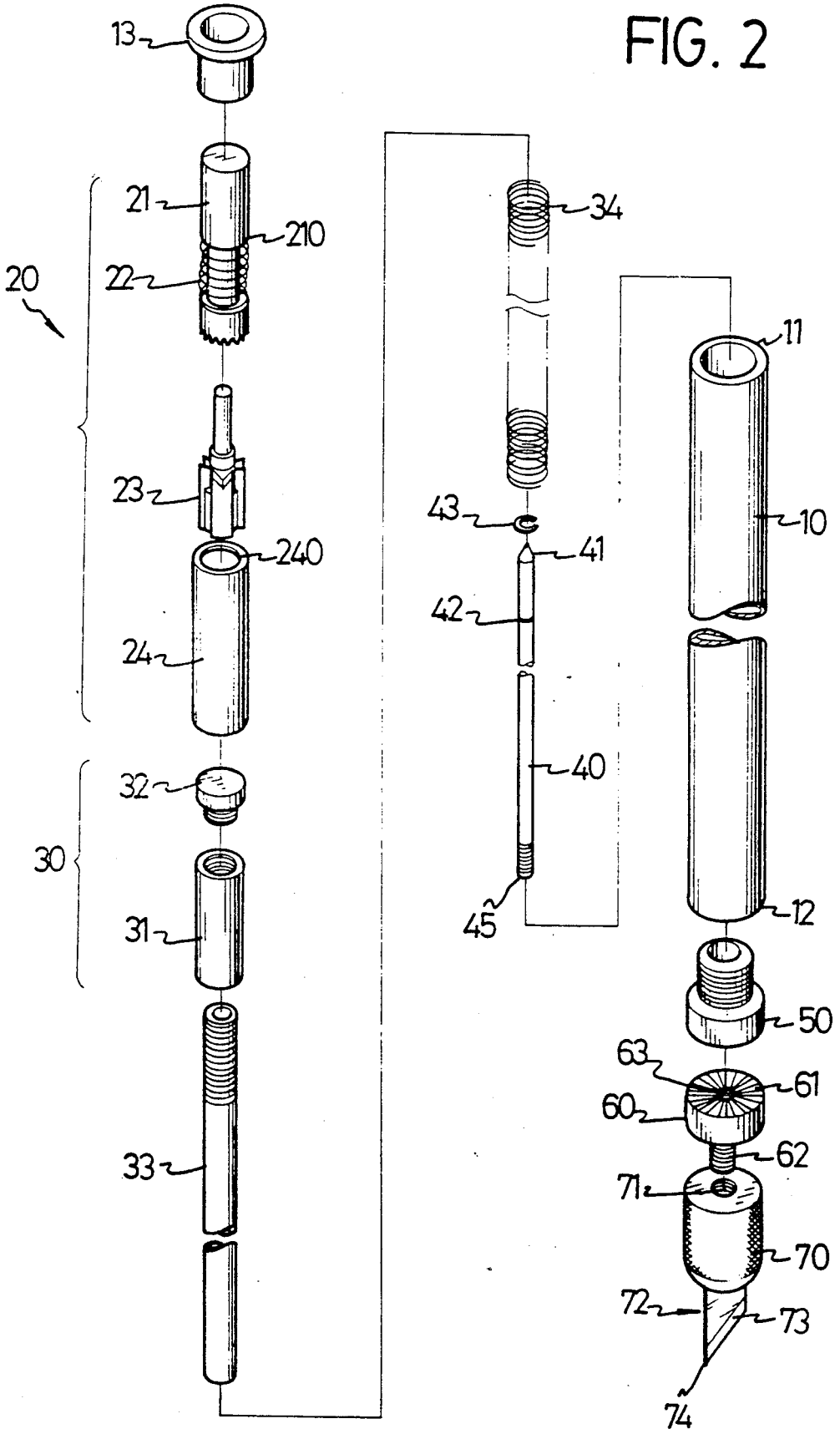
FIG. 2 is an exploded view of FIG. 1.
Figure 3:
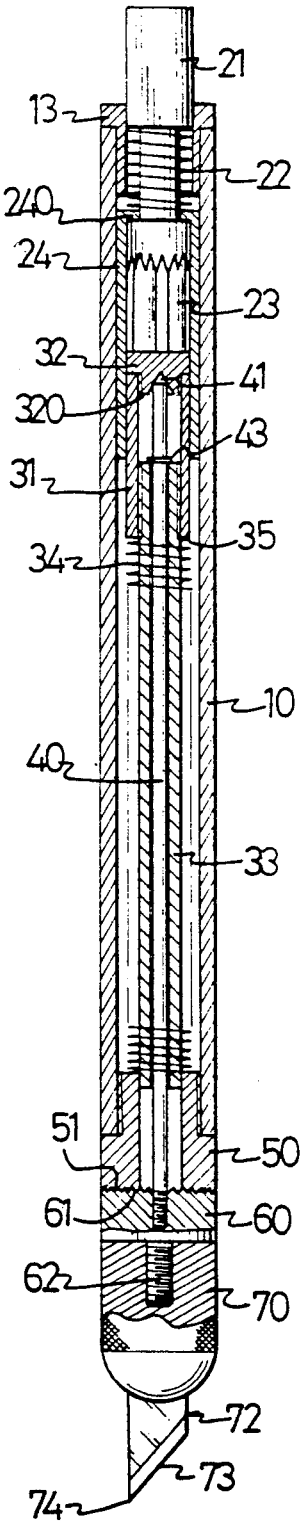
FIG. 3 is a cross-sectional view showing the utility knife functioning in a non-rotatable mode.
Figure 4:
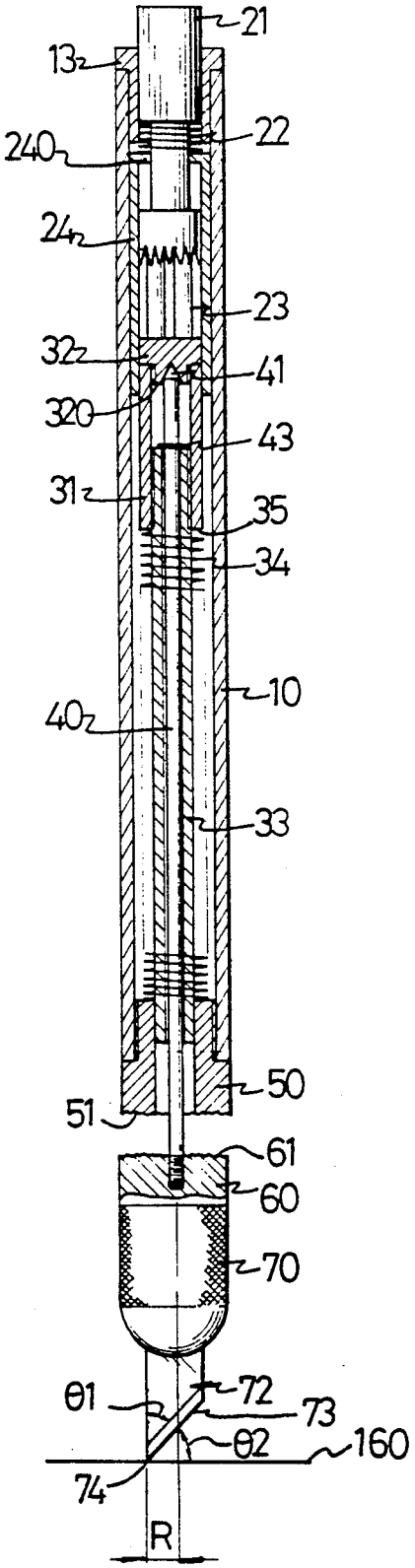
FIG. 4 is a cross-sectional view showing the utility knife functioning in a rotatable mode.

Referring to FIGS. 2 to 4, the utility knife comprises a barrel 10 having an upper end Il and a lower end 12. An upper cap 13 and a lower cap 50, each having a passage therethrough, are attached to the upper end 11 and the lower end 12 respectively. A switching button means 20 includes an outer tube 24, a contact bar 23, a button 12, and a second spring 22. The outer tube 24 has protruding bars formed therein for cooperating with the button 21 and the contact bar 23 to enable the button in either upper stable position or lower stable position. The button 2I has a first shoulder 2I0 in the middle portion thereof. The second spring 22 is securely installed around lower portion of the button 21, with two ends of the second spring 22 respectively against the first shoulder 210 of the button 21 and an upper end of the outer tube 24, as shown in FIGS. 3 and 4. The contact bar 23 and a lower portion of the button 21 are slidably received in the outer tube 24 which is securely attached to an upper portion of an inner periphery of the barrel 10.

For example, if the knife is in a non-rotatable mode, the button 21 remains in a relatively upper position with respect to the upper cap I3, as shown in FIG. 3. The knife can be switched to a rotatable mode by manually pressing the button 21 which will enable the contact bar 23 to switch from a relatively upper stable position to a relatively lower stable position in the outer tube 24, as shown in FIG. 4. If the knife is in a rotatable mode, the button 21 is in a relatively lower position with respect to the upper cap 13, as shown in FIG. 4. The knife can be switched to a non-rotatable mode by manually pressing the button which will enable the contact bar 23 to switch from a relatively lower stable position to a relatively upper stable position in the outer tube 24, as shown in FIG. 3. The switching button means 20 is a well known device which is not described in detail herein.

A bearing means 30 slidably received in the outer tube 24 of the switching button means 20 includes a third cap 32 engaged to a first tube 31, with the third cap 32 upward against the contact bar 23 of the switching button means 20. The third cap has a notch 320 therein, as shown in FIGS. 3 and 4 for the purpose described later.

A second tube 33 is securely engaged to the first tube 31, thereby forming a second shoulder portion 35 therebetween, as shown in FIGS. 3 and 4. A first spring 34 encloses the second tube 33, with two ends thereof respectively against the second shoulder portion 35 and the lower cap 50. Therefore, when the knife is in a rotatable mode, the contact bar 23 is in a stable lower position forcing the second shoulder portion 35 to depress the first spring 34, as shown in FIG. 4. When the knife is switched from rotatable mode to non-rotatable mode, the button 21 of the switching button means 20 is in a relatively upper position with respect to the upper cap 13 and the first spring 34 forces the bearing means 30 upward, which in turn upwardly forces the contact bar 13 against the button 21. The button 21 has its bottom end remain inside the outer tube 24 by an inner flange 240 of the outer tube 24.

A rod 40 having a tip end 41 and an engaging end 45 is rotatably while not slidably received in the first tube 31 and the second tube 33 with the tip end 41 against the notch 320 of the third cap 32 while the engaging end 45 protrudes out of the second cap 50 and further connects to a connector means 60.

The rod 40 has a groove 42 near the tip end 41 thereof for receiving a C-ring 43 which is also in the first tube 31 and rests on an upper end of the second tube 33 while received inside the first tube 31, thereby limiting the rod 40 to a constant position with respect to the second tube 33.

The lower cap 50 has a first engaging surface 51 (FIGS. 3 and 4), and the connector 60 has a second engaging surface 61, such as a toothed surface, for cooperatively engaging to each other when the button 2I is in an upper stable position, i.e. the knife is in a non-rotatable mode, as shown in FIG. 3.

The connector 60 has a first socket 63 in the center of the second engaging surface for receiving the engaging end 43 of the rod 40 and a plug end 62 for engaging to the head 70.

The head 70 has a second socket 71 at one end thereof for engaging to the plug 62 of the connector 60 and a blade 72 disposed thereon at another end, such that when the contact bar 23 remains in the upper stable position, the connector 60 is engaged to the second cap 50 giving the knife its non-rotatable capability, as shown in FIG. 3; when the contact bar 23 is located in the lower stable position, the connector 60 disconnects with the second cap 50, whilst the rod 40 having its tip 41 against the notch 320 of the third cap 32, constitutes a rotation axle of the head 70, enabling the knife to function in the rotatable mode, as shown in FIG. 4. The notch is used to limit the tip 41 of the rod 40 to rotate therein when the utility knife is in the rotatable mode.

Referring to FIG. 4 when cutting with the utility knife, as long as the user makes a curved cut, the lateral force he applies on the barrel 10 will transmit to the rod 40 up to the notch 320 of the third cap 32 and cause a corresponding rotation of the rod 40 to force the blade 72 to make a corresponding turn to form a curved cut.

The blade 72 may be fitted into the head 70 by injection molding.

Referring to FIG. 4, the blade 72 has two longitudinal sides and a cutting edge 73 which ends with a cutting point 74. The cutting edge 73 "dissects" the longitudinal (parallel) sides at an angle, i.e., not perpendicularly, such that the interior angle $\theta 1$ defined at the cutting point 74 is acute. The cutting edge 73 has an acute angle 82 with the object surface 160. The cutting edge 73 is substantially transverse to the axis of the rod 40 thereby forming a radius R between the cutting point 74 and the axis of the rod 40.

I claim:

1. A utility knife for switching between a non-rotatable mode to cut a straight line or a rotatable mode to cut a curve, comprising:

a barrel (10) having an upper end (11) and a lower end (12);

an upper cap (13) and a lower cap (50) each having a passage therethrough being attached to said upper end (11) and said lower end (12) of said barrel (10) respectively;

a switching button means (20) having a contact bar (23) therein being securely received in the upper end (11) of said barrel (10) and being manually operable to position said contact bar (23) in an upper stable position or a lower stable position;

a bearing means (30) slidably received in said switching button means (20) having a third cap (32) engaged to a first tube (31), with said third cap (32) against said contact bar (23) of said switching button means (20);

a second tube (33) securely engaged to said first tube (31), thereby forming a shoulder portion (35) therebetween;

a first spring (34) enclosing said second tube (33) with two ends thereof respectively against said shoulder portion (35) and said lower cap (50);

a rod (40) having a tip end (41) and an engaging end (45) rotatably while not slidably received in said first tube (31) and said second tube (33) with said tip end (41) against said third cap (32) while said engaging end (43) protrudes out of said lower cap (50) and further connects to a connector means (60);

a head (70) having a second socket (71) at one end thereof for engaging to said connector (60) and a blade (72) disposed thereon at another end, such that when said contact bar (23) remains in the upper stable position said connector (60) is engaged to said second cap (50) causing said knife to function in the non-rotatable mode, when said contact bar (23) remains in the lower stable position said connector (60) disconnects with said lower cap (50), said rod (40) constituting a rotation axle of said head (70) causing said knife to function in the rotatable mode.

2. A utility knife as claimed in claim 1, wherein said lower cap (50) has a first engaging surface (51), said connector (60) has a second engaging surface (61) for engaging to each other when said utility knife is in a rotatable mode.

3. A utility knife as claimed in claim 2, wherein said connector (60) has a first socket (63) in the center of the second engaging surface for receiving said engaging end (45) of said rod (40) and a plug end (62) for engaging to said second socket (71) of said head (70).

4. A utility knife as claimed in claim 1, wherein said rod (40) has a groove (42) near the tip end (41) thereof for receiving a C-ring (43) which contacts against an upper end of said second tube (33) while received inside said first tube (31) thereby limiting said rod (40) to a constant relative position with respect to said second tube (33).

5. A utility knife as claimed in claim 1, wherein said third cap (32) has a notch (320) therein for limiting said tip (41) to rotate therein when said utility knife is in the rotatable mode.

6. A utility knife as claimed in claim 1, wherein said blade (72) has a sloping cutting edge and at the end thereof is a cutting point (74), said cutting edge (73) being substantially transverse to the axis of said rod (40) thereby forming a radius (R) between said cutting point (74) and said axis of said rod (40).

* * * * *